United States Patent [19]

Yamamoto et al.

[11] Patent Number: 4,799,531

[45] Date of Patent: Jan. 24, 1989

[54] CASTING METHOD IN HIGH-PRESSURE CASTING

[75] Inventors: Tadashi Yamamoto; Michiyuki Suzuki, both of Yamaguchi, Japan

[73] Assignee: UBE Industries, Inc., Ube, Japan

[21] Appl. No.: 77,122

[22] Filed: Jul. 23, 1987

[30] Foreign Application Priority Data

Jul. 31, 1986 [JP] Japan ..... 61-178747

[51] Int. Cl.[4] ..... B22D 17/00; B22D 17/20

[52] U.S. Cl. ..... 164/120; 164/113

[58] Field of Search ..... 164/97, 98, 113, 120, 164/121

[56] References Cited

U.S. PATENT DOCUMENTS 3,528,478 9/1970 Koch et al. ..... 164/113

3,905,415 9/1975 Lefebvre ..... 164/113 X 4,512,383 4/1985 Suzuki et al. ..... 164/113 X 4,550,762 11/1985 West et al. ..... 164/98

FOREIGN PATENT DOCUMENTS 54-28731 3/1979 Japan ..... 164/97

59-21460 2/1984 Japan ..... 164/97

59-78766 5/1984 Japan ..... 164/97

*Primary Examiner*—Nicholas P. Godici

*Assistant Examiner*—J. Reed Batten, Jr.

*Attorney, Agent, or Firm*—Blakely, Sokoloff, Taylor & Zafman

[57] ABSTRACT

In a method of feeding a molten metal in metal molds through a casting sleeve to cast a predetermined article, a hollow thin-plate body is provided to at least an inner wall surface portion of the casting sleeve near the molds.

20 Claims, 4 Drawing Sheets

CASTING METHOD IN HIGH-PRESSURE CASTING

BACKGROUND OF THE INVENTION

The present invention relates to a casting method in high-pressure casting such as die casting or squeeze casting.

In high-pressure casting such as die casting or squeeze casting, if a molten metal cast in a cavity is rapidly cooled and solidified, the molten metal does not reach edge portions of the cavity and the quality of the cast product is degraded. In order to prevent this, the molten metal is cast in the molds at high speed, and the molds and the casting sleeve are kept at a predetermined temperature. After casting, the molten metal must be rapidly cooled and solidified.

For this purpose, a heat-insulating material, a solid asbestos, or solid paper is adhered to molten metal contact surfaces of the conventional molds and sleeve, a mold release agent is applied thereto, the molds and sleeve are made of a ceramic material, or the molds and sleeve are heated by a heater.

Of these conventional heating techniques, when a ceramic material is used, a heat-retention effect can be obtained to some extent since the material has a small heat conductivity. However, such a material cannot provide a good cooling effect. When a heater is used, a good heat-retention effect can be obtained when the molds are heated to a temperature near that of the molten metal. In this case, rapid cooling at a high pressure cannot be properly performed. In addition, even if a heat-insulating material is adhered to the molten metal contact surfaces, rapid cooling cannot be expected. When the mold release agent is applied to the molten metal contact surfaces, burning of these surfaces can be prevented. However, heat retention and rapid cooling cannot be properly performed. When asbestos is adhered to the molten metal contact surfaces, a good heat-retention effect can be obtained. However, when a temperature exceeds 500° C., asbestos is oxidized to generate a gas. The gas or the burnt asbestos is mixed in the molten metal to cause product defects. In addition, the burned and carbonized pieces are attached to the molds to decrease heat conductivity, thereby preventing rapid cooling. When paper is adhered to the molten metal contact surfaces, paper is subjected to oxidation and decomposition at a high temperature and a toxic gas is generated.

SUMMARY OF THE INVENTION

It is, therefore, an object of the present invention to provide a casting method in high-pressure casting, which eliminates the conventional drawbacks described above.

In order to achieve the above object of the present invention, there is provided a casting method in high-pressure casting in a method of feeding a molten metal to metal molds through a casting sleeve to cast a predetermined article, wherein a hollow thin-plate body is provided to at least one of inner wall surface portions of the casting sleeve and the metal molds which are brought into contact with the molten metal to mold it.

According to the present invention, when the molten metal supplied to a casting sleeve is fed to a cavity, no pressure acts on the molten metal in the initial period. The molten metal is brought into contact with a hollow thin-plate body having a small contact area and a low heat conductivity and is thus heated. When the thin-plate body is carbonized by combustion or the like, the temperature of the molten metal is maintained by the carbonized and the hollow portion. When the molten metal is then compressed, the molten metal permeates into the hollow thin-plate body or the hollow thin-plate member or the carbide is crushed to bring the molten metal into contact with an inner wall surface having a relatively low temperature. The heat from the molten metal can be immediately absorbed by the inner wall surface, and the molten metal is rapidly cooled and solidified.

BRIEF DESCRIPTION OF THE DRAWINGS

FIGS. 1 to 8 are views for explaining a casting method in high-pressure casting according to the present invention, in which:

FIG. 1 is a view showing the overall structure of a die cast machine;

FIG. 2 is a longitudinal sectional view of molds and a casting sleeve in the die cast machine shown in FIG. 1;

FIG. 3 is an enlarged sectional view of a molten metal in the initial period of molten metal injection;

FIG. 4 is an enlarged sectional view of the mold after the molten metal is compressed;

FIG. 5 is a graph showing a change in molten metal during molten metal injection;

FIG. 6 is a graph showing a change in the mold during molten metal injection;

FIG. 7 is an enlarged sectional view of a mold during the initial period of molten metal injection according to another embodiment of the present invention, showing a state corresponding to the state shown in FIG. 3; and FIG. 8 is an enlarged sectional view of the mold after the molten metal is compressed, showing a state corresponding to the state shown in FIG. 4.

DESCRIPTION OF THE PREFERRED EMBODIMENTS

Figure 1:
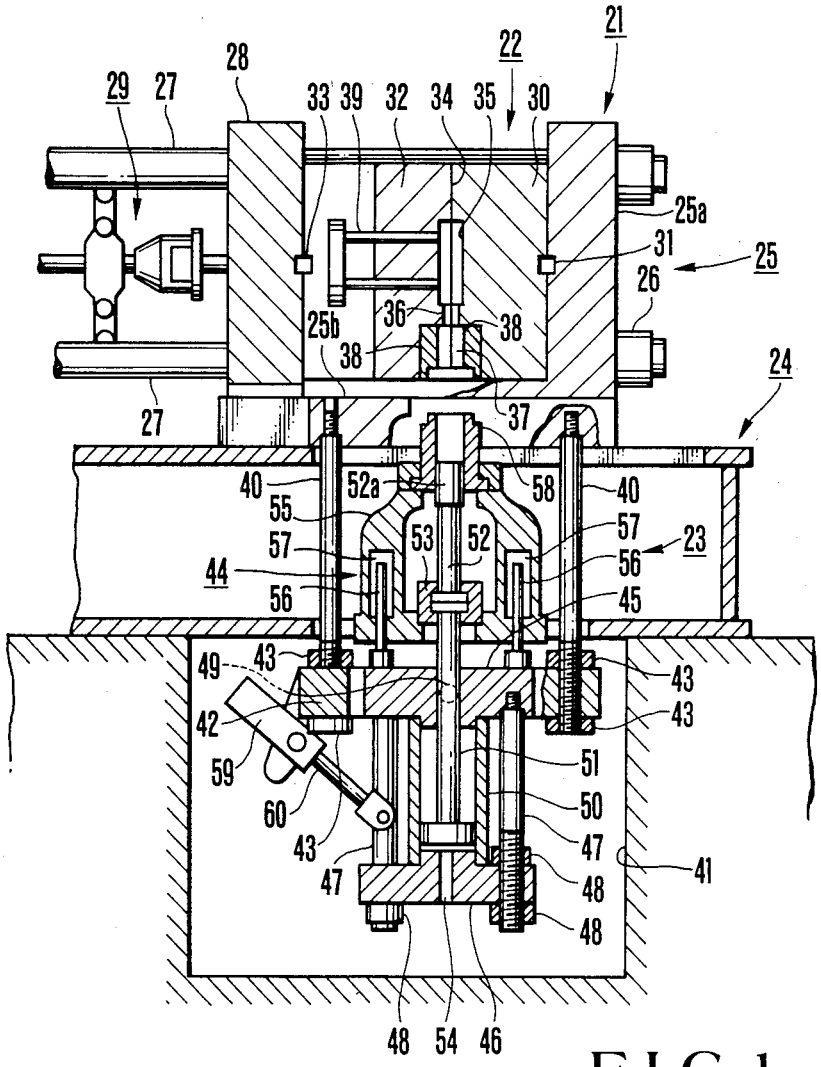

A die cast machine 21 of an embodiment shown in FIG. 1 is constituted by a horizontal mold clamping unit 22, and a vertical casting unit 23. The horizontal mold clamping unit 22 is secured on a base 24 of the machine secured to the floor and extending in the horizontal direction as viewed in FIG. 1. A stationary platen 25 is secured to an edge of an opening formed at the rear end of the upper surface of the base 24. The stationary platen 25 has an L shape including a substantially square vertical member **25*a* and a horizontal member 25*b* extending toward a movable platen 28 to be described later. The width of the horizontal member 25*b* secured to the base 24 is slightly smaller than that of the vertical member. The other stationary platen, not shown, is adjustably secured to the other end of the base 24 to oppose the stationary platen 25. These two stationary platens are connected together by columns 27 secured to four corners of the stationary platens. The movable platen 28 is slidably fitted on columns 27 to oppose the stationary platen 25 and connected to the mold clamping cylinder of the other stationary platen, not shown, through a toggle mechanism 29. A stationary metal mold 30 is mounted on the stationary platen 25 and prevented from moving in the vertical direction by a key 31, while a movable metal mold 32 is mounted on the movable platen 28 and prevented from moving in the vertical direction by a key 33. Thus, the metal molds 30 and 32** are moved relatively in the horizontal direction to abut on each other at a split or mating plane 34. When clamped together, the metal molds 30 and 32 define a mold cavity 35, a throat 36 beneath it, and a vertical opening 37 contiguous to the throat 36. A split sleeve 38 is secured to the inner surface of the vertical opening 37. A push out device 39 is provided for the movable metal mold 32 to remove the cast product.

The vertical casting unit 23 is provided with four depending supporting members in the form of tie rods 40 threaded into the horizontal member 25*b* of the stationary platen 25. The spacing between the tie rods 40 is smaller than that of the columns 27. The tie rods extend through the base 24 into a bin 41 below the floor surface. The lower ends of the tie rods 40 are secured by nuts 43 to four corners of a supporting beam 42 having a U shaped configuration when viewed from above. An injection device generally shown by reference numeral 44 is rotatably supported by the supporting beam 42. The injection device 44 comprises a rectangular upper stationary board 45 and a lower stationary board 46 which are interconnected by 4 tie rods 47 with their upper ends threaded into the upper stationary board 45 and the lower ends secured to the lower stationary board 46 by nuts 48. The upper stationary board 45 is provided with a vertical pin 49 at the center, and the pin 49 is clamped between the two legs of the U shaped supporting beam 42 so as to rotatably support the injection device 44 with the supporting beam 42. An injection cylinder 50 is clamped between the upper and lower stationary boards 45 and 46 at their central portions. A piston rod 51 of the injection cylinder 50 extends upwardly through the upper stationary board 45, and a plunger 52 is connected to the upper end of the piston rod 51 through a coupling 53. The lower stationary board 46 is provided with an oil supply port 54. A dome shaped block 55 is supported by a pair of pins 56 secured to the upper stationary board 45, and the bottom of the block 55 is shaped to receive the coupling 53. The block 55 is moved in the vertical direction by admitting pressurized oil into cylinders 57 of the block and by the vertical movement of the piston rod 51. To the upper end of the block 55 is secured a cylindrical casting sleeve 58 coaxial with and having the same diameter as the stationary sleeve 38. With the piston rod 51 elevated, when the block 55 is raised by the pressurized oil admitted into the cylinders 57, the casting sleeve 58 is urged against the stationary sleeve 38, whereas when block 55 is lowered, both sleeves are separated away. A tilting cylinder 59 is secured to the upper stationary board 45 and the free end of its piston rod 60 is pivotally connected to one tie rod 47 so that when the piston rod 60 is retracted, the injection device 44 is tilted about the pin 49 to enable pouring of the molten metal into the casting sleeve 58.

The die cast machine described above operates as follows:

After inserting plunger 52 in the casting cylinder 58, the tilting cylinder 59 is operated to tilt the injection device 44 about pin 49. After pouring molten metal into the casting sleeve 58 with a dipper or the like, the tilting cylinder 59 is operated in the opposite direction to bring the injection device 44 to the vertical position. Then pressurized oil is simultaneously introduced into the cylinders 57 and the injection cylinder 50 so as to raise the casting sleeve 58 and the plunger 52 for urging the casting sleeve 58 against the lower end of the stationary sleeve 38. Then the movable metal mold 32 is moved by the mold clamping cylinder through the toggle mechanism 29 and the movable platen 28 to clamp both metal molds 30 and 32. After urging the casting sleeve 58 against the stationary sleeve 38, pressurized oil is introduced into the injection cylinder 50 to raise plunger 52 for injecting the molten metal into the mold cavity 35 through sleeves 58 and 38 and throat 36. After injection and cooling of the cast product, the casting sleeve 58 is separated away from the metal molds 30 and 32. After opening the molds by operating the mold clamping cylinder, the cast product is removed from the metal molds 30 and 32 by the push out device 39, thus completing one cycle.

Figure 2:
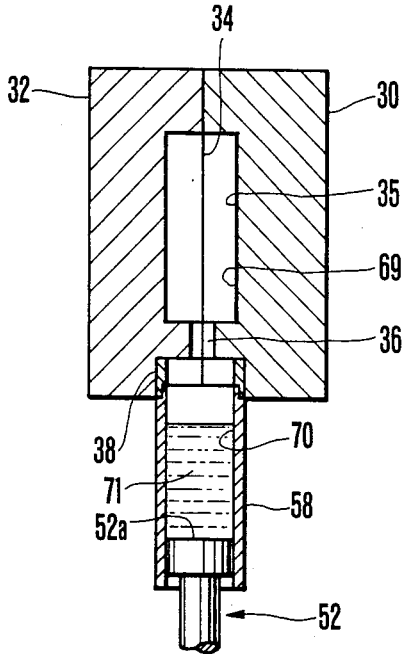
Figure 3:
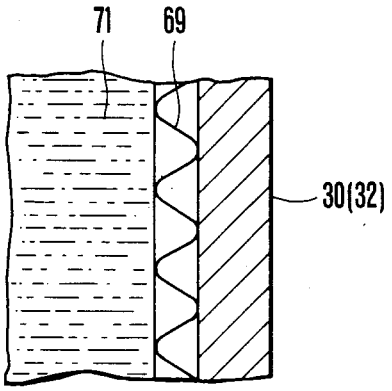
Figure 4:
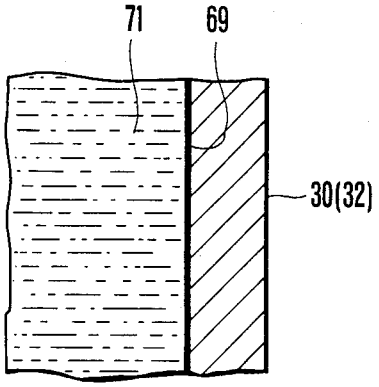

FIG. 2 shows molds and a casting sleeve in a die cast machine for explaining a casting method according to the present invention, FIG. 3 shows the mold in the initial period of molten metal injection, and FIG. 4 shows the mold after the molten metal is compressed. The die cast machine is of a horizontal mold clamping and vertical injection type, as described in U.S. Pat. No. 4,655,274. Referring to FIGS. 2 to 4, mold cavities 35 are respectively formed on both sides of the split or mating plane 34 between the stationary metal mold 30 and the movable metal mold 32 when they are closed. The stationary sleeve 38 is fitted in a sleeve hole formed through the constricted portion or throat 36 below the cavities 35. Reference numeral 58 denotes the cylindrical casting sleeve supported by the sleeve frame 55 (FIG. 1). The casting sleeve 58 can be detachably mounted in the stationary sleeve 38 upon reciprocal movement of the sleeve frame. A plunger tip 52*a* of the plunger 52 reciprocated by the injection cylinder 50 is fitted in the inner hole of the casting sleeve 58.

Porous thin-plate members 69 and 70 made of, e.g., porous paper-like alumina-silica ceramic fibers are adhered to the inner wall surfaces of the cavities 35 of the metal molds 30 and 32 and the inner wall surfaces of the sleeves 38 and 58 through a mold release agent such as water-soluble graphite.

A casting method by the die cast machine having the thin-plate bodies 69 and 70 will be described below. The casting sleeve 58 detached from the stationary sleeve 38 is inclined to inject a molten metal 71 such as Al. The casting sleeve 58 is vertically aligned with the stationary sleeve 38 and is inserted therein by a cylinder. When the plunger 52 is moved forward by an injection cylinder, the molten metal 71 passes through the stationary sleeve 38 and the constricted or gate portion 36 and is injected inside the cavities 35. The molten metal is brought into contact with the inner wall surface of the casting sleeve 58 and the inner wall surfaces of the metal molds 30 and 32 before molten metal injection and in the initial period thereof. In this case, since the molten metal is not compressed, it is not permeated into thin-plate bodies 69 and 70. The thin-plate bodies 69 and 70 have a good heat-insulating property by air in the porous body and a good heat-retention property by a small contact surface area. The temperature of the molten metal 71 contacting the bodies 69 and 70 is maintained constant. FIG. 3 shows a state of the mold in the initial period of molten metal injection. It should be noted that the thin-plate body used in this embodiment is a ceramic fiber plate having a thickness of 0.5 to 2 mm and that the ceramic fibers can withstand temperatures of 1,300° C. to 1,500° C. and have a strength of 4 kg/25 mm (1-mm thick) at a porosity of 90 to 95%.

When the plunger 52 is further moved forward, the molten metal 71 is fitted in the cavities 35 and is compressed. The pressure exceeds the permeation pressure of the plate-like bodies 69 and 70 and the molten metal 71 enters inside the bodies 69 and 70. As shown in FIG. 4, the molten metal 71 reaches the inner wall surfaces of the metal mold 30 (32). The molten metal 71 is abruptly cooled by the inner wall surface and is solidified.

Figure 5:
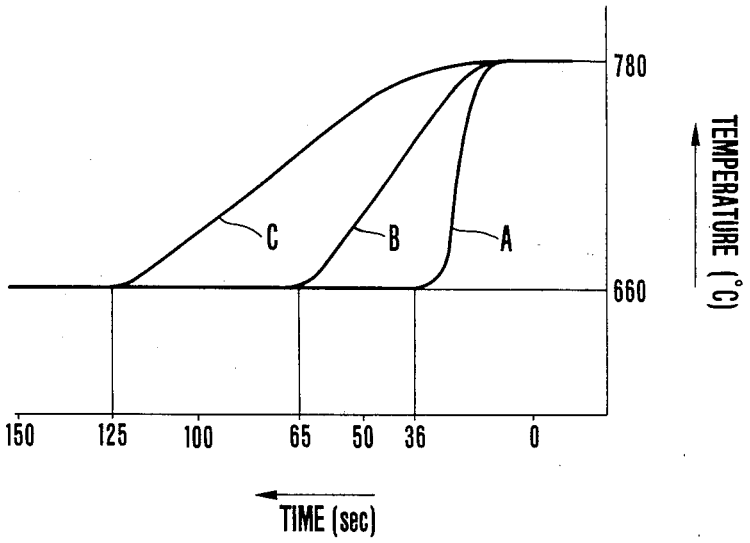

FIG. 5 is a graph showing a change in temperature of the molten metal from the start of molten metal injection to its solidification. The temperature is plotted along the ordinate, and time is plotted along the abscissa. Curve A shows a change in temperature of the molten metal wherein a heat-insulating material is not used. Curve B shows a change in temperature of the molten metal wherein asbestos as a hollow member (not hollow) is used as the heat-insulating material. Curve C shows a change in temperature of the molten metal wherein ceramic fibers according to the present invention are used as the heat-insulating material. In this case, the temperature of pure molten aluminum 71 is 780° C., and the temperature of the metal molds 30 and 32 are kept at 170° to 200° C. As is apparent from FIG. 5, while a time required for cooling the molds without any heat-insulating material to a given temperature is a few seconds, a time required for cooling the molds having the ceramic fibers, i.e., the plate-like member 69 is one minute and several tens of seconds. The molds having asbestos as the heat-insulating material have a plot intermediate between the above cases.

Figure 6:
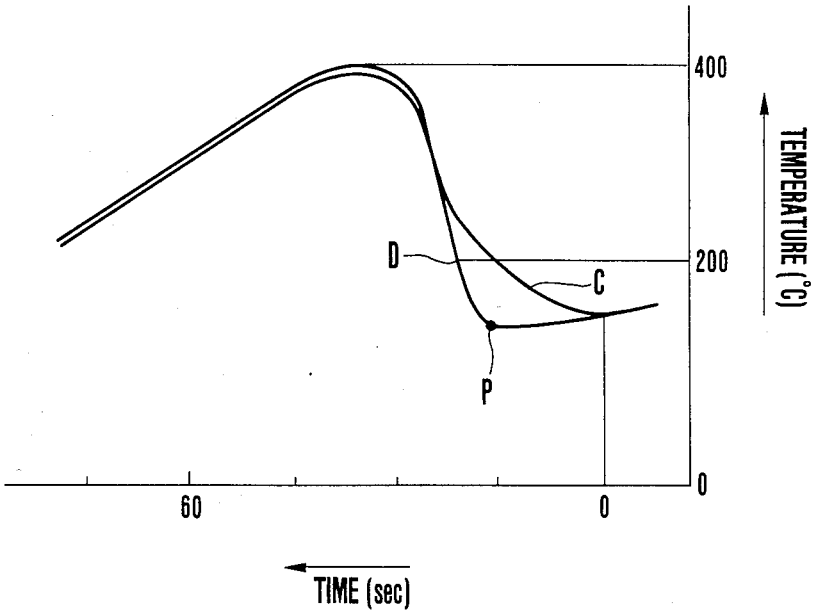

FIG. 6 is a graph showing a change in temperature of the molds for a period of time from initiation of molten metal injection to its solidification. The temperature is plotted along the ordinate and time is plotted along the abscissa. Curve C shows a change in mold temperature when a heat-insulating material is not used. Curve D shows a change in mold temperature when the ceramic fibers in the form of bodies 69 and 70 are used according to this embodiment. As is apparent from FIG. 6, when the molten metal 71 is compressed at a position indicated by point P, the molten metal 71 is brought into contact with the metal molds 30 and 32, and the temperature of the molds 30 and 32 is increased. After the temperature of the molds 30 and 32 is increased, the cooling effect of the molten metal 71 by the molds 30 and 32 is the same as indicated by curves C and D.

Figure 7:
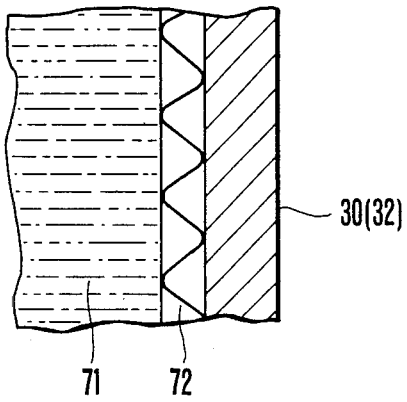
Figure 8:
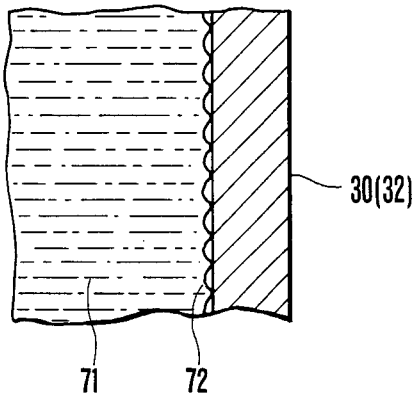

FIGS. 7 and 8 show another embodiment of the present invention. FIG. 7 shows the mold in the initial period of molten metal injection in a state corresponding to the state shown in FIG. 3, and FIG. 8 shows the mold after molten metal compression in a state corresponding to the state of FIG. 4. In this embodiment, a hollow thin-plate body containing air inside comprises, e.g., honeycomb thin-plate bodies 72. Other arrangements in the second embodiment are the same as those in the first embodiment.

With the above arrangement, when the molten metal 71 is filled in cavities 35 of stationary and movable metal molds 30 and 32, the temperature of the molten metal 71 is maintained by the heat-insulating property given by the air sealed in the honeycomb thin-plate bodies 72 in the initial period of molten metal injection (FIG. 7) since no pressure acts on the molten metal 71 in the same manner as in the first embodiment. However, when the molten metal 71 is continuously injected in the cavities and a pressure acts thereon, the thin-plate bodies 72 are crushed by the pressure of the molten metal 71, as shown in FIG. 8. The molten metal 71 reaches and is brought into contact with the inner wall surface of the mold 30 (32). The heat of the molten metal 71 is rapidly conducted to the mold 30 (32). Therefore, the molten metal 71 is rapidly cooled and solidified.

A case will be described wherein a material subjected to combustion or thermal decomposition by heat from the molten metal is used to form a hollow thin-plate body containing air inside. Examples of the hollow thin-plate body are ceramic fibers, cardboard, and asbestos, all of which contain an organic binder and are easily carbonized by heat of the molten metal and strength withstanding the weight of the molten metal.

When the molten metal 71 is injected while the hollow thin-plate bodies of the material subjected to combustion or thermal decomposition are adhered to the inner wall surfaces of the molds 30 and 32, the ceramic fibers are combusted and carbonized by heat from the molten metal 71 within the initial period of molten metal injection. In this case, a large amount of oxygen is supplied to the hollow portion of the ceramic fibers open to the outer atmosphere to cause active oxidation. A toxic gas produced by this reaction is immediately removed through the hollow portion open to the outer atmosphere. For this reason, the toxic gas is not mixed in the molten metal 71. The hollow portion formed between the molten metal and the mold wall surface by combustion of the ceramic fibers, and the carbide in the hollow portion have a heat-insulating property, and reaction heat is generated by this combustion. Therefore, the temperature of the molten metal 71 is maintained by the heat-insulating property and the reaction heat, thus obtaining a good heat-retention effect. If a metal powder subjected to a thermit reaction (heat is generated by an oxidation reaction) is filled in the hollow portion formed by combustion, a better heat-retention effect can be obtained. Since the ceramic fibers are carbonized by combustion, mold releasing and lubrication can be accelerated. When the molten metal 71 is then compressed, the carbide of the ceramic fibers is crushed to bring the molten metal into contact with the mold wall surface, and the molten metal is rapidly cooled and solidified in the same manner as in the above embodiments.

In the above embodiments, porous ceramic fibers, porous or hollow cardboards, or porous or hollow asbestos are used to form hollow thin-plate bodies containing air inside. However, a hollow body may be made of a porous metal (e.g., Al or Cu), a porous ceramic, or a sponge-like ceramic. In particular, when a good heat-retention effect is required, a ceramic material is preferred. An inorganic binder as a ceramic fiber binder is better than an organic binder which decomposes and generates a gas at a high temperature of 500° to 900° C. In each embodiment, the porous body is adhered to the mold wall surface through a mold release agent. However, a molded body having an outer shape matching with the inner shapes of the molds may be set in the molds. Alternatively, a thin plate may be bent to fit in the molds, or a porous body may be coated on or sprayed to the inner wall surfaces of the molds.

In the above embodiments, thin-plate bodies are respectively adhered to the inner wall surfaces of the molds and the sleeve. However, the thin-plate body may be adhered to only the inner wall surface of the sleeve. Thin-plate bodies may be provided to the inner wall surface of the sleeve and the gate portion to obtain a better effect. However, it is essential to provide the thin-plate body to at least the inner wall surface of the casting sleeve near the molds so as to achieve the object of the present invention. Thin-plate bodies may be formed on the entire or partial inner surfaces of the die cast machine members. The heat-retention and rapid cooling effects can be arbitrarily controlled by properly selecting a material, a porosity, a thickness and setting method of the thin-plate bodies as well as the material and temperature of the molds. A gas sealed in the thin-plate body is exemplified by air in the above embodiment. However, any gas may be used in the inner space and a vacuum (state of being sealed off from external influences; absence of matter) may be formed between the thin-plate body and the inner wall surface of the sleeve and/or mold due to the following reason. A time for setting the molten metal inside the casting sleeve or the like is relatively long. Before and during casting, the temperature of the molten metal is kept constant as much as possible. After casting, a biscuit solidified in the upper portion of the casting sleeve has a relatively large volume to constitute a block. Therefore, the biscuit portion must be immediately cooled to advantageously shorten the cycle time.

As has been apparent from the above description according to the casting method in high-pressure casting of the present invention, a thin-plate body containing a gas whose interior is sealed off from the external influences of the inner wall surface serves as a molten metal contact surface, thereby casting the molten metal. During the initial period of molten metal injection, the molten metal is in contact with the hollow thin-plate body having a small contact surface area having a heat-insulating property, a combusted hollow portion, a hollow carbide body or the like so that the temperature of the molten metal can be sufficiently kept constant due to air or vacuum inside the above-mentioned member. However, when the molten metal is compressed, the molten metal is permeated into the thin-plate body or crushes the thin-plate body or the carbide due to the pressure of the molten metal and is rapidly cooled by the mold wall surfaces. Therefore, ideal heat-retention and rapid cooling effects can be obtained to greatly improve quality of cast products. Without losing the heat-retention effect, the molds and the sleeve can be sufficiently cooled to prevent burning of the molten metal.

The present invention is not limited to the particular embodiment. Various changes and modifications may be made within the spirit and scope of the invention. In the above embodiment, the present invention is applied to a horizontal mold casting and vertical injection type die cast machine. However, the present invention is also applicable to vertical mold casting and injection type die cast machines described in U.S. Pat. No. 4,088,178, U.S. Pat. No. 4,286,648, and U.S. Pat. No. 4,287,935 as well as a squeeze casting machine in place of a die cast machine.

What is claimed is:

1. A method of pressure die casting molten metal including a casting sleeve and metal molds comprising the steps of:

disposing a thin-plate body having hollows adjacent to at least one inner wall surface of said casting sleeve;

pouring said molten metal into said casting sleeve;

injecting said molten metal from said casting sleeve into said metal molds; and applying pressure to said molten metal in said casting sleeve and said metal molds, wherein said pressure is sufficient to exceed the permeation pressure of said thin-plate body having hollows;

whereby said molten metal infiltrates into said hollows and is substantially solidified upon contact with said inner wall surface of said casting sleeve.

2. A method as recited in claim 1, wherein said thin-plate body is porous.

3. A method as recited in claim 1, wherein said thin-plate body contains a gas in said hollows thereof.

4. A method as recited in claim 1, wherein said thin-plate body contains a vacuum space therein.

5. A method as recited in claim 1, wherein said thin-plate body is disposed adjacent to a gate portion between said metal molds and said casting sleeve.

6. A method as recited in claim 1, wherein said thin-plate body is disposed adjacent to at least one inner wall surface of said metal molds.

7. A method as recited in claim 1, wherein said thin-plate body is a honeycomb structure.

8. A method of pressure die casting molten metal including a casting sleeve and metal molds comprising the steps of:

disposing a thin-plate body having hollows adjacent to at least one inner wall surface of said metal molds;

pouring said molten metal into said casting sleeve;

injecting said molten metal from said casting sleeve into said metal molds; and applying pressure to said molten metal in said casting sleeve and said metal molds, wherein said pressure is sufficient to exceed the permeation pressure of said thin-plate body having hollows;

whereby said molten metal infiltrates into said hollows and is substantially solidified upon contact with said inner wall surface of said metal molds.

9. A method as recited in claim 8, wherein said thin-plate body is porous.

10. A method as recited in claim 8, wherein said thin-plate body contains a gas in said hollows thereof.

11. A method as recited in claim 8, wherein said thin-plate body contains a vacuum space therein.

12. A method as recited in claim 8, wherein said thin-plate body is disposed adjacent to a gate portion between said metal molds and said casting sleeve.

13. A method as recited in claim 8, wherein said thin-plate body is disposed adjacent to at least one inner wall surface of said casting sleeve.

14. A method as recited in claim 8, wherein said thin-plate body is a honeycomb structure.

15. A method of pressure die casting molten metal including a casting sleeve and metal molds comprising the steps of:

disposing a thin-plate body having hollows adjacent to at least one inner wall surface of said casting sleeve and at least one inner wall surface of said metal molds;

pouring said molten metal into said casting sleeve;

injecting said molten metal from said casting sleeve into said metal molds; and applying pressure to said molten metal in said casting sleeve and said metal molds, wherein said pressure being sufficient to exceed the permeation pressure of said thin-plate body having hollows;

whereby said molten metal infiltrates into said hollows and is substantially solidified upon contact with said inner wall surface of said casting sleeve.

16. A method as recited in claim 15, wherein said thin-plate body is porous.

17. A method as recited in claim 15, wherein said thin-plate body contains a gas in said hollows thereof.

18. A method as recited in claim 15, wherein said thin-plate body contains a vacuum space therein.

19. A method as recited in claim 15, wherein said thin-plate body is disposed adjacent to a gate portion between said metal molds and said casting sleeve.

20. A method as recited in claim 15, wherein said thin-plate body is a honeycomb structure.

* * * * *